US005711529A

United States Patent [19]

Nielsen et al.

[11] Patent Number: 5,711,529

[45] Date of Patent: Jan. 27, 1998

[54] MIRROR GAME

[76] Inventors: Brent B. Nielsen, 2547 W. 11275 South; Lynn S. Nielsen, 1948 W. 11585 South, both of South Jordan; Lester T. Nielsen, 11852 S. Shady Acres Court, Riverton, all of Utah 84095

[21] Appl. No.: 568,652

[22] Filed: Dec. 7, 1995

[51] Int. Cl.[6] ..... A63F 9/06

[52] U.S. Cl. ..... 273/441; 359/880

[58] Field of Search ..... 273/441, DIG. 17, 273/351, 444; 351/50; 359/880; 434/258

[56] References Cited

U.S. PATENT DOCUMENTS

| | | | |
|---|---|---|---|
| 631,227 | 8/1899 | Peppard | 273/DIG. 17 X |
| 1,776,175 | 9/1930 | Wittekind | 273/DIG. 17 X |
| 2,502,224 | 3/1950 | Kozloff | 351/50 X |
| 3,074,319 | 1/1963 | McGovern . | |
| 3,111,313 | 11/1963 | Parks | 273/444 |
| 3,184,884 | 5/1965 | Petrucelli | 273/DIG. 17 X |
| 3,833,300 | 9/1974 | Rymes . | |
| 3,951,414 | 4/1976 | Nunez | 273/DIG. 17 X |
| 4,100,557 | 7/1978 | Doan | 359/880 X |
| 4,175,743 | 11/1979 | Messina . | |
| 4,193,594 | 3/1980 | Schwauss . | |
| 4,651,357 | 3/1987 | Gershoni . | |
| 4,813,680 | 3/1989 | Rudell et al. | 273/DIG. 17 X |
| 4,953,859 | 9/1990 | West . | |
| 5,275,419 | 1/1994 | Kazemi | 273/DIG. 17 X |
| 5,393,068 | 2/1995 | Kane . | |
| 5,432,960 | 7/1995 | Kraut . | |

FOREIGN PATENT DOCUMENTS

| | | | |
|---|---|---|---|
| 641768 | 5/1962 | Canada | 273/441 |
| 1097040 | 2/1995 | France | 273/351 |

*Primary Examiner*—Paul E. Shapiro
*Attorney, Agent, or Firm*—Thorpe, North & Western

[57] ABSTRACT

A mirror game including a visual image alteration device has a mirror positioned therein to alter an image seen in the mirror by a person playing the game. A support mechanism is used to hold the mirror adjacent the eyes of the user so that the user looks into the mirror to see the altered image. An attachment device is used to hold the support device to the head of the user so that the support device is suspended therefrom. An upper wall, a lower wall, side walls and a flange member limit the player's vision to only the altered image as seen through the mirror. A method of playing a game comprises selecting a playing surface with a design; selecting a movable member; attaching a mirror adjacent a player's eyes; positioning the mirror so that an image seen in the mirror by the player is altered; disposing an upper wall, a lower wall and side walls for limiting the players ability to see unaltered items; disposing a flange member on the lower wall to limit visualizations to the image of the playing surface seen by the player to that seen in the mirror; and looking into the mirror and moving the movable member along the design.

11 Claims, 5 Drawing Sheets

MIRROR GAME

BACKGROUND OF THE INVENTION

1. Field of the Invention

The present invention relates to a game for one or more players and, in particular, to a game using a mirror which is suspended from the head of a person playing the game and disposed adjacent the eyes of the player in such a manner to invert or otherwise distort the image seen by the player as the player attempts to draw a line through a maze.

2. Prior Art

The playing of novelty games in which a player attempts to draw a line through a maze is well known. To make these games more challenging, numerous inventions have been conceived for inverting the image seen. Because the image is inverted, the person playing the game must react in an opposite way to that indicated by the visual image seen by the person. While it is easy to draw a line through even complex mazes when viewed naturally, inverting the image substantially increases the difficulty. Thus, a person must usually practice several times before being able to draw a line through even a simple maze without crossing the boundaries of the maze.

An early example of such a game device is disclosed in U.S. Pat. No. 3,074,319. The patent discloses an optical game device which has a viewer disposed above a writing surface such as a piece of paper. As the user looks into the viewer and attempts to connect dots, etc., the image he or she sees is inverted, thereby complicating the task.

One disadvantage of the arrangement shown in the '319 patent is that the user may easily circumvent the device by slightly adjusting the position or his or her head and looking down onto the paper. Additionally, because the viewer is stationary, the person playing with the device is able to reorient himself or herself after using the device several times. In this situation, the player can more easily adapt to the inverted effects, because the paper orientation will always remain substantially the same when the mirror is supported on a stable support platform.

A subsequent game involving inversion of the playing surface by a mirror is disclosed in U.S. Pat. No. 4,193,594. A piece of paper or some other surface is placed on a base and a mirror is disposed so that the inverted image of the paper is visible to the player. A shield is then placed between the player's eyes and the piece of paper to prevent the player from looking directly at the piece of paper. In one embodiment the mirror is disposed adjacent the base and angled so that it may be viewed by the player. In another embodiment, it is attached to the shield which is in turn attached to the marking device which is used on the paper.

Such a device is disadvantageous in that the player may learn to use fixed positions which are not inverted by the mirror to assist in movement. Thus, for example, if it appears that the pen should be moved toward the players left, he or she will know to move it toward a fixed object on his or her right. By making several such associations, a skilled player will be able to master the game within a short period of time; analyzing the needed movement indicated by the visualization of fixed positions and then translating the apparently needed movement into the movement actually needed.

Yet another optical inversion game is taught in U.S. Pat. No. 4,953,859. The game device includes an area for placing paper or some other surface to mark and a mirror disposed to provide an inverted view of the surface. A shield is provided to prevent the player from viewing the paper. A hole is formed in the shield to allow the users hand to mark on the paper.

As with the '594 patent, the '859 patent allows players to use fixed objects adjacent the game as reference points which may be relied upon to derive the real movements needed to successfully complete the maze disposed on the piece of paper. Additionally, the devices taught in the '594 patent and the '319 patent do not allow any significant change in orientation and do not allow the persons playing the game to look past the fixed position.

Thus a more challenging mirror game is desired wherein a person directs a position indicator, such as a marking pen, through a maze formed on a playing surface which is also subject to changing visual orientation. In such a game, a device should be provided which alters the image into an image which is seen by the player without fixing the position of the player relative to the maze. Additionally, the visual image alteration device provided should prevent the user from circumventing the disorienting effect of the mirror by moving his or her head slightly to see the unaltered image.

SUMMARY OF THE INVENTION

Thus, it is an object of the present invention to provide a mirror game which is more challenging than the inverted imaging games of the prior art.

It is another object of the present invention to provide such a game which is inexpensive to manufacture and is easy to use.

It is another object of the present invention to provide such a game wherein the game is not stationary and may be played with numerous different playing surfaces.

It is still another object of the present invention to provide an inverted imaging game which prevents the user from using fixed, noninverted objects adjacent the game as reference points for determining the necessary direction of movement.

It is still yet another object of the present invention to prevent the person playing the game from circumventing the inverting of the image and looking directly at the playing surface.

It is an additional object of the present invention to provide a game in which the image which is viewed by the person playing the game is altered in a manner other than simply being inverted.

The above and other objects of the invention are realized in specific illustrated embodiment of a visual image alteration device having a mirror positioned therein to alter an image seen in the mirror, a support mechanism for holding the mirror adjacent the eyes of the user so that the user looks into the mirror to see the altered image, and an attachment device for holding the support device to the head of the user so that the support device is suspended therefrom.

In accordance with one aspect of the invention, the visual image alteration device is used with a playing surface having a pattern formed thereon and a moveable indicator for movement along the pattern. The user of the alteration device views the altered image of the pattern on the playing surface and then tries to move the indicator along the surface.

In accordance with another aspect of the present invention, the visual image alteration device is used with a playing surface formed by a piece of paper with a maze drawn or otherwise disposed thereon. The moveable indicator is a marking device, such as a pencil or pen, and is moved by the player so that the player receives an altered view of the movements of the marking device in the mirror.

In accordance with another aspect of the present invention, the visual image alteration device is used with a playing surface in the form of a floor. The pattern is a maze disposed on the floor. The player is the moveable indicator as he or she attempts to walk between the lines defining the maze. The mirror in the visual image altering device inverts or otherwise alters the image so that the player may not react intuitively to the visual image seen in the mirror if he or she is to be successful in navigating the maze without crossing the boundary lines.

In accordance with another aspect of the invention, the mirror is curved or otherwise formed to deform the image reflected to the player. The mirror may be formed to exaggerate or reduce width dimensions, or otherwise distort the image seen. Thus, to succeed in moving the movable indicator through the maze without crossing the line, the player must be able not only to adjust for the inverted image, but also must be able to adjust for the extent of any distortion.

In accordance with another aspect of the invention, a plurality of mirrors may be provided, each having a different distortion. The player may then use the same mazes repeatedly, as the visual image of each maze will change with each change in the orientation of any one of the mirrors. Thus, by changing mazes and mirrors, a significant number of combinations are achieved to keep the game interesting over a prolonged period of time.

In accordance with another aspect of the present invention, a shield is provided adjacent the mirror to prevent the player from looking at the pattern except at the view provided by the mirror. The shield typically is disposed so that it also prevents the player from using fixed reference points to thereby adjust the directions of his or her movements.

In accordance with still yet another aspect of the invention, the visual image alteration device is formed by a shield and mirror which are formed as an integral unit. The unit is attached to the player's head so that the player may only see the image in the mirror. If the player moves his or her head, the mirror images will move and reorient accordingly.

In accordance with an additional aspect of the invention, the attachment mechanism for holding the support device to the users head may be an elastic strap, a hat, or ear hooks which wrap around a user's ears in a similar fashion to those used on glasses.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention and should not be viewed as narrowing the pending claims.

Figure 1:
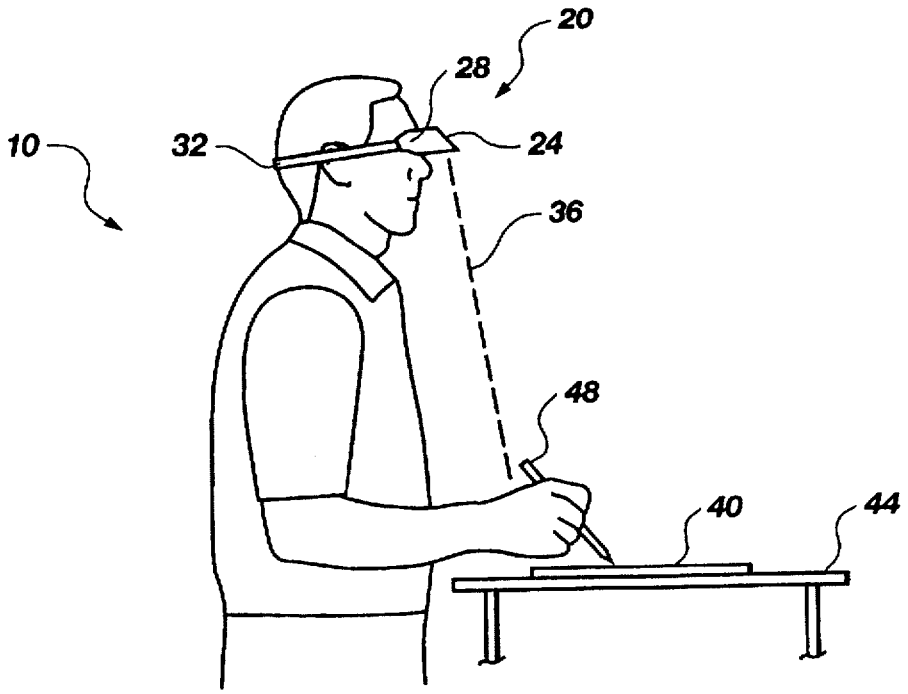
FIG. 1 shows a side view of a person playing the mirror game of the present invention with a visual image alteration device attached to his head adjacent his eyes.

Referring to FIG. 1, there is shown a side view of a person, generally indicated at 10, playing the mirror game of the present invention. Attached to the head of the person is a visual image alteration device, generally indicated at 20. The visual image alteration device 20 includes a support frame 24 which is disposable adjacent the eyes 28 of the person. The support frame 24 holds a mirror (not shown) which is used to alter the view seen by the person 10.

The support frame 24 of the visual image alteration device 20 is held to the user so that the support frame is suspended from the head of the person. As will be explained in additional detail below, suspending the support frame 24 from the head of the person 10 significantly increases the challenge involved in mirror games and enables the visual image alteration device 20 to be used in other situations in which the prior art devices would not be usable.

Typically, the support frame 24 is held adjacent the eyes 28 of the person 10 by a strap 32. The strap 32 may be made of a resilient material, such an elastic, so as to expand or contract to snugly fit on the player's head.

The mirror (not shown) which is disposed within the support frame 24 of the visual image alteration device 20 is positioned so that the player 10 looking straight ahead sees a reflected (inverted) image of the area below the image alteration device 20. Thus, the visual path outside of the support frame 24 is represented by the generally vertical dashed line 36.

As shown in FIG. 1, a playing surface which is seen by the person 10 using the image altering device 20 is a piece of paper 40 which is positioned on a table 44. The object of the game is to guide a movable indicator, such as the pen 48, to draw a line through a maze (not shown) on the paper 40 without crossing its boundaries. U.S. Pat. Nos. 4,193,594 and 4,953,859 teach such a maze formed by an inner star and an outer star; the object of the invention being to draw a line completely around the inner star without contacting it or the outer star. Numerous other designs may be used to increase or decrease the level of difficulty.

Because of the mirror disposed in the support frame 24, the image seen by the person 10 playing the game is the inverse of the actual maze. Thus, the instinctive reaction of the player 10 to the image he or she sees through the visual image alteration device 20 will be to move the pen 48 in the opposite direction than is actually required to successfully navigate the maze. Thus, unless the player 10 is able to quickly translate perceived directions into actual directions he or she will repeatedly cross the boundaries of the maze. Of course, when such games are played as a group, rules may be developed which asses points for each time the boundaries of the maze are crossed.

Figure 2:
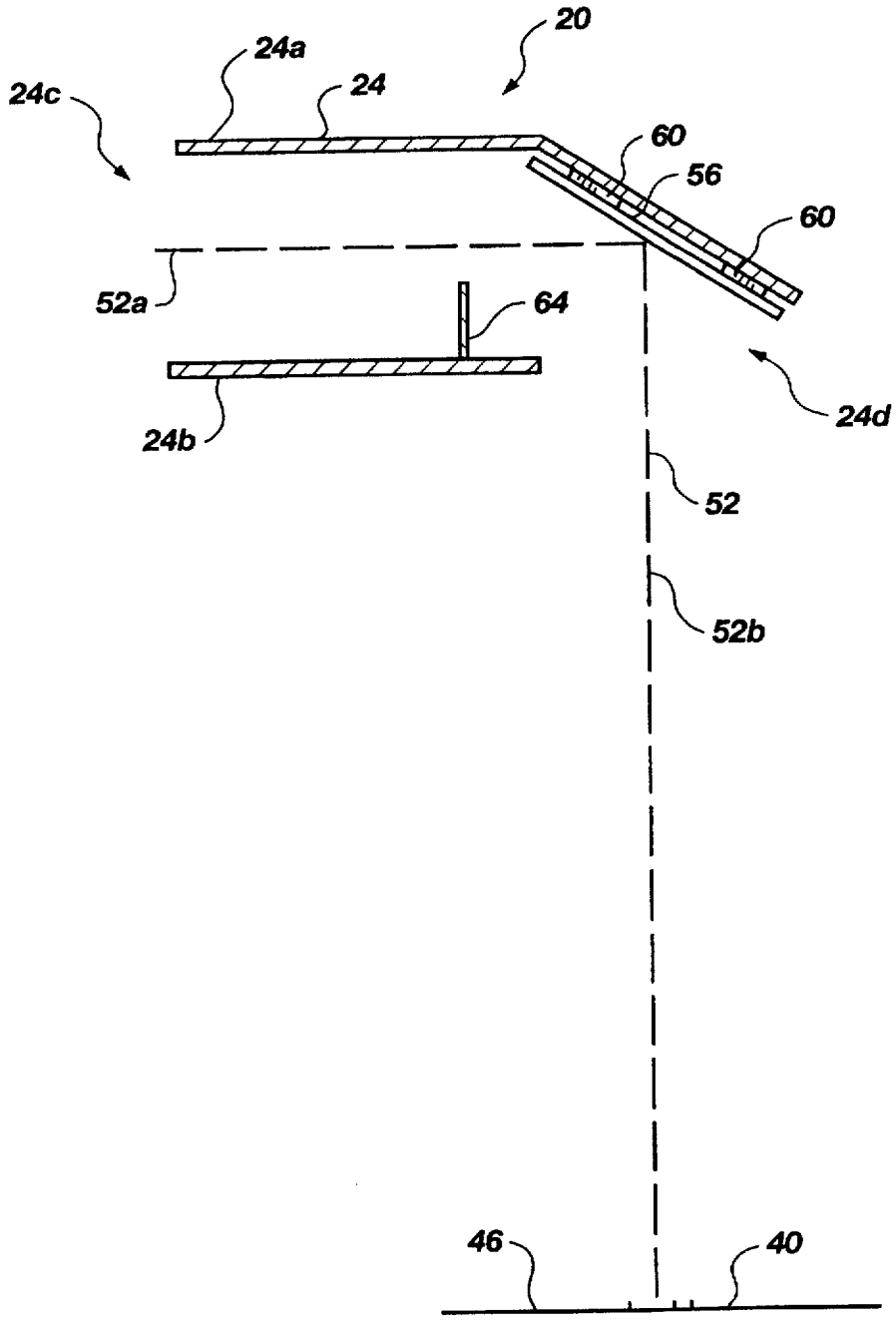
FIG. 2 shows a side cross-sectional view of a visual image alteration device made in accordance with the teachings of the present invention.

Referring now to FIG. 2, there is shown a cross-sectional view of a visual image alteration device 20 made in accordance with the teachings of the present invention. The visual image alteration device 20 includes the support frame 24. The support frame 24 has an upper wall **24*a* and a lower wall 24*b* which are disposed to define a visual path, indicated by the dashed line 52. The visual path 52 has a horizontal portion 52*a* and a vertical portion 52*b***.

A mirror 56 is disposed in the end of the support frame 24 at the junction of the horizontal and vertical portions **52*a*** and 52*b*, respectively. Typically, the mirror will be disposed between 30 and 60 degrees with respect to the horizontal portion of the visual path. The mirror 56 inverts or otherwise alters the image along the visual path 52. Those familiar with reflection in mirrors will appreciate that a person looking into an open first end 24*c* of the support frame will see an inverted image of playing surface 40 in the mirror 56 disposed at the open second end 24*d*. As shown in FIG. 2, the first open end 24*c* is generally disposed at a 90 degree angle to the second open end 24*d*.

To increase the difficulty of the mirror game of the present invention, the mirror 56 can be curved to provide additional distortion. Thus, for example, the mirror 56 may be formed so that the image 46 on the playing surface 40 appears elongated, etc. Those skilled in the art will be familiar with numerous such mirrors.

To keep the game challenging, the mirror 56 could be releasably attached to the support frame 24 at attachment points 60 so that mirrors with different curvatures could be used. Once the players had mastered a particular maze with the mirror 56, a new mirror could be replaced therefor to provide a new challenge. With several differently configured mirrors and different mazes, a large number of combinations are achieved with very little expense.

Also shown in FIG. 2 is a flange member 64 extending upwardly from the lower wall 24*b* of the support frame. The flange member 64 prevents the user from being able to see through the second open end 24*d* other than reflections from the mirror. Because of the height of the flange 64, the user is forced to look into the mirror 56 instead of out the second open end 24*d*. Thus, the flange 64 prevents the user from being able to see an unaltered view of the maze 46 on the playing surface 40. In addition to the flange, the upper and lower walls 24*a* and 24*b*, respectively, serve as a shield to prevent the user from seeing an unaltered view of the playing surface. While not shown in FIG. 2, the support frame 24 also includes side walls which act as blinders to prevent the person playing the game from taking a quick peak at the playing surface.

Figure 3A:
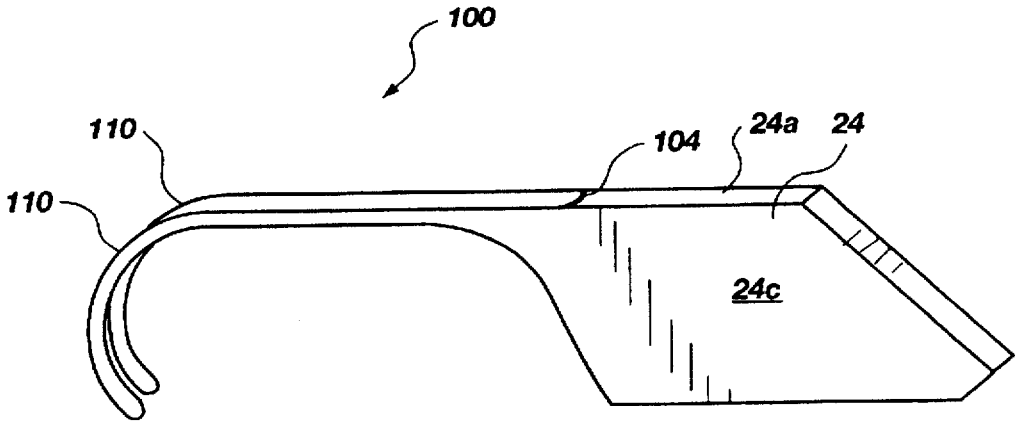
FIG. 3A shows a side view of an alternate embodiment of the visual image alteration device of the present invention.

Referring now to FIG. 3A, there is shown a side view of a visual image alteration device of the present invention, generally indicated at 100. The alteration device 100 includes a support frame 24 which is substantially the same as that discussed with respect to FIGS. 1 and 2, and is thus labeled accordingly. Also shown in FIG. 3A is a side wall 24*e* of the support frame 24 which prevents the user from taking a quick look at the playing surface (not shown in FIG. 3A).

The upper wall 24*a* of the support frame 24 ends in a contoured edge 104 adjacent the first open end (FIG. 2) so as to conform to the head of the person using the device. The edge 104 could have a padded surface thereon to prevent the support frame 24 from marking the user.

The support frame 24 is attached to the user by a pair of ear hooks 110 similar to those found on a conventional pair of glasses. The ear hooks 110 hold the support frame 24 during use so that the mirror (FIG. 2) in the support frame is suspended from the head of the user and moves with any movements thereof.

Such an arrangement provides a challenging mirror game because the wearer must constantly readjust to the changing orientation of the visualized playing surfaces. Unlike the prior art in which the reflecting mirror remained stable and the user could rely on fixed landmarks, etc., to provide relative orientation, the mirror used in the present invention is constantly moving. Even a slight twist of the head causes momentary disorientation of the user. Because the only images which are visible are those which are seen in the mirror, there are no fixed landmarks which may be used to reorient oneself. Thus, mirror games using the present invention are considerably more challenging.

Figure 3B:
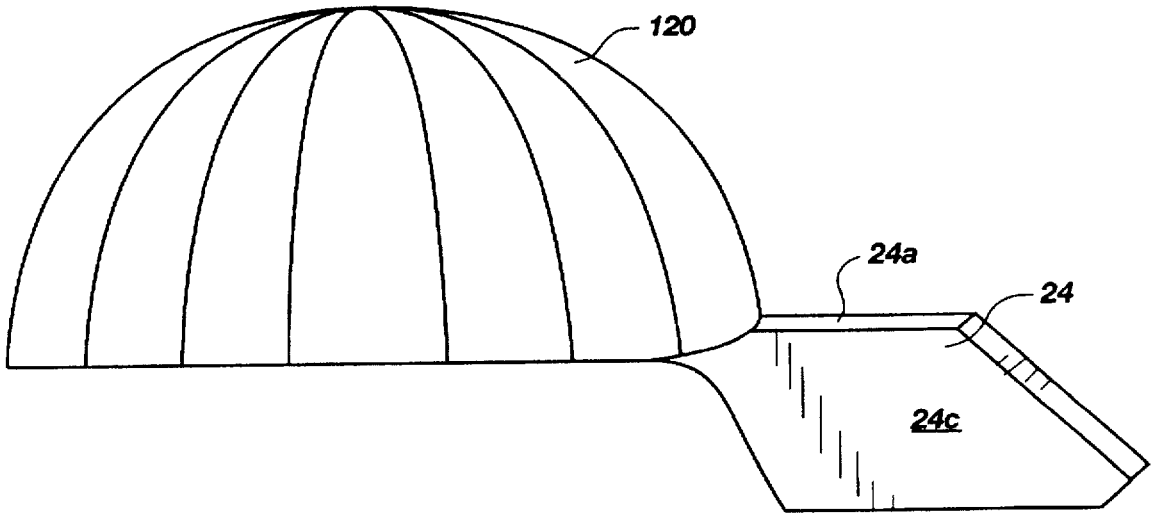
FIG. 3B shows a side view of yet another embodiment of the visual image alteration device of the present invention.

Referring now to FIG. 3B, there is shown yet another embodiment of the present invention. A support frame 24 which is substantially the same as that discussed with respect to FIGS. 1 through 3A is provided. Instead of a strap 32 (FIG. 1) or ear hooks 110 (FIG. 3A), the support frame 24 is attached to the user by a hat 120. Typically, the hat 120 will be fashioned in a similar manner to a conventional baseball cap. However, virtually any hat which can engage a head sufficiently to hold the support frame 24 can be used. this will include most hats as the visual image alteration devices 20 of the present invention are typically made of plastic and are extremely light in weight.

Figure 4:
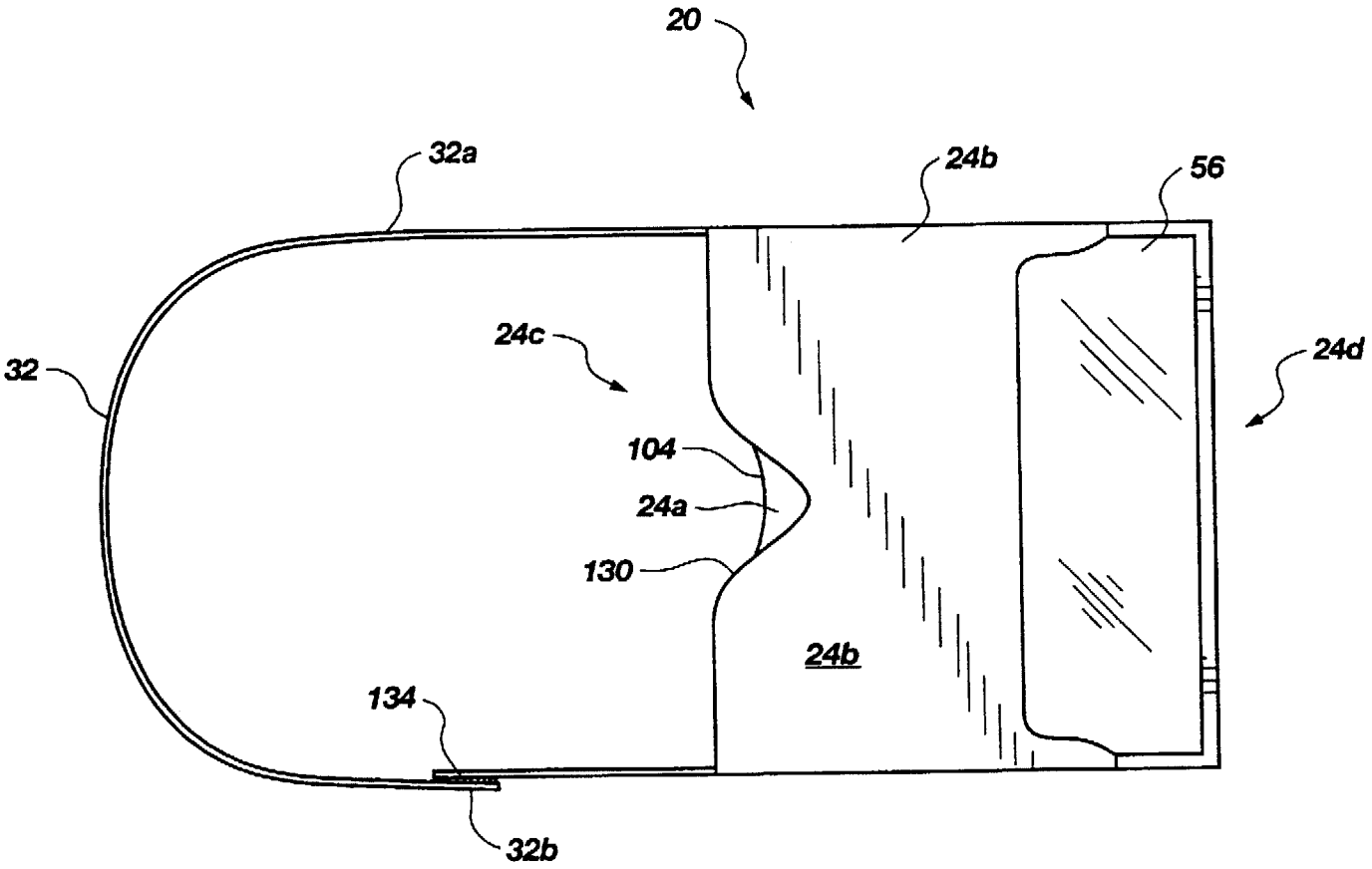
FIG. 4 shows a bottom view of the visual image alteration device shown in FIG. 2.

FIG. 4 shows a bottom view of the visual image alteration device 20. The support frame 24 has a bottom wall 24 with a indentation 130 formed therein for fitting about the nose of the user. As with the edge 104 of the upper wall 24*a*, a pad could be disposed along the edge 134 of bottom wall for additional comfort.

The strap 32 which is used to hold the support frame 24 to the user, is fixedly attached to the support frame at a first end 32*a*. An opposing second end 32*b* of the strap 32 can be attached to the support frame 24 by a hook and loop fastener 134 or some other releasable attachment device so that the strap can be easily attached and removed.

Figure 5:
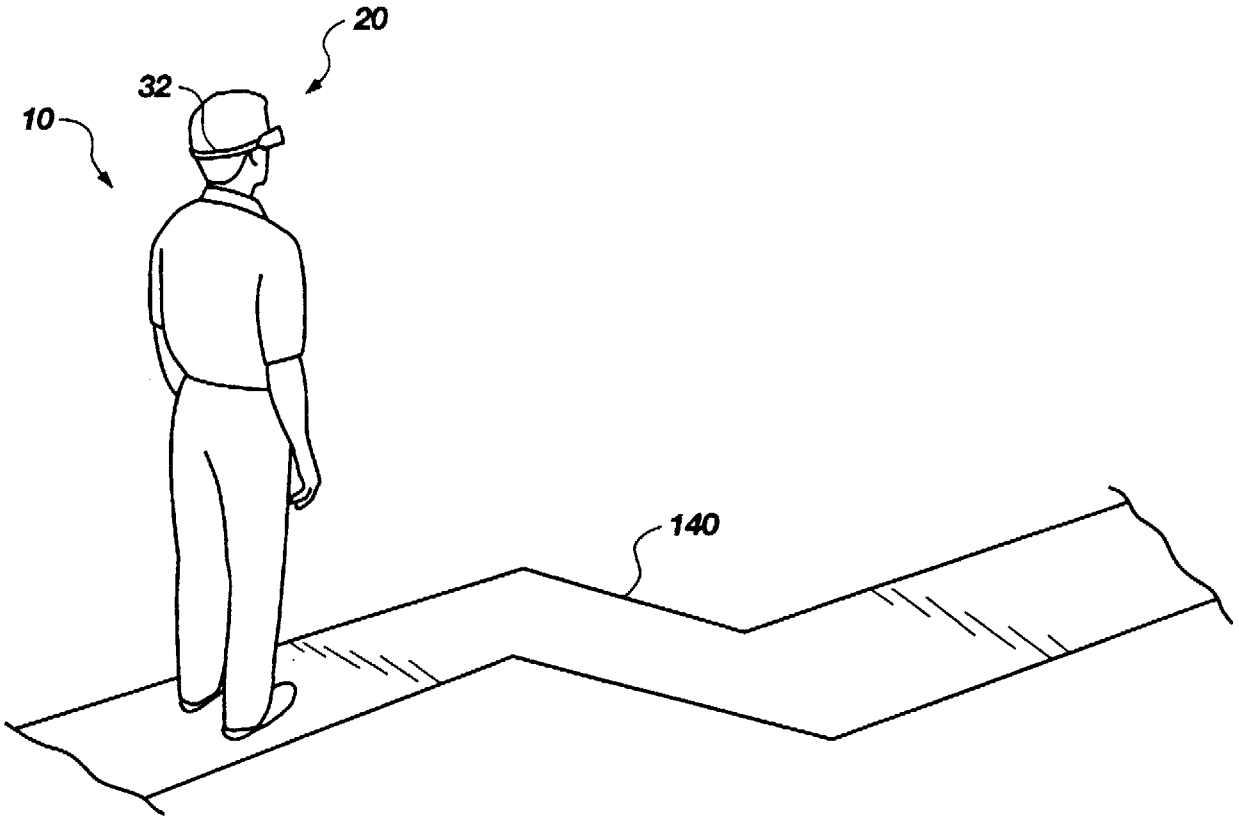
FIG. 5 shows a perspective view of a person using the visual image alteration device to walk through a maze disposed on a floor.

Referring now to FIG. 5, there is shown a perspective view of an alternate use of the visual image alteration device 20 of the present invention. The alteration device 20 is worn in the same manner as discussed above. Instead of being used to draw a line through a maze, however, the alteration device 20 is used by a person attempting to navigate a maze 140 formed on the floor. Thus, the person 10 wearing the alteration device 20 acts as the moveable indicator which moves along the pattern or design on the playing surface. While the maze 140 shown in FIG. 5 appears to be relatively simple, the visual image alteration device 20 disorients the user sufficiently to render the maze a significant challenge. Even requiring a user to walk on a straight line can be difficult due to the disorientation which occurs when using the alteration device.

Those skilled in the art will appreciate that the visual image alteration device 20 can be used in numerous different games. For example, instead of drawing a line through a maze or walking through the maze, the alteration device 20 could be used in a game in which the players attempt to copy other drawings.

Thus, there is disclosed a mirror game and a visual image alteration device for use therein. Those skilled in the art will recognize numerous modifications which can be made without departing from the scope and spirit of the present invention. The appended claims are intended to cover such modifications.

What is claimed is:

1. A novelty game for one or more players comprising:

a playing surface having a maze disposed thereon;

a moving device for moving through the maze;

a head piece attachable to a player so that the head piece is suspended from the player's head;

a mirror disposed in the head piece to alter a visual image of the maze viewed by the player in the mirror;

the head piece having an upper wall, a lower wall and side walls for limiting the ability of the player to see items not altered by the mirror; and a flange member extending upwardly from the lower wall to limit the ability of the player to observe the playing surface to that image viewed in the mirror.

2. The game of claim 1, wherein the head piece includes a support frame for holding the mirror adjacent the player's eyes.

3. The game of claim 2, wherein the head piece comprises a strap for attaching the support frame to the player's head.

4. The game of claim 2, wherein the head piece comprises ear hooks extending from the support frame.

5. The game of claim 2, wherein the head piece comprises a hat attached to the support frame.

6. The novelty game of claim 1 wherein the upper wall and lower wall define a visual path therethrough, the visual path having a horizontal portion and a vertical portion.

7. The novelty game of claim 6, wherein the mirror is disposed along the visual path to invert an image reflected thereby.

8. The novelty game of claim 7, wherein the mirror is disposed at an angle of between 30 and 60 degrees relative to the visual path.

9. A method for playing a game comprising:

(a) selecting a playing surface having a design formed thereon;

(b) selecting a movable member for movement along the design on the playing surface;

(c) attaching a mirror to a player adjacent the player's eyes so as to suspend the mirror from the player;

(d) positioning the mirror in an orientation so that an image seen in the mirror by the player is altered;

(e) disposing an upper wall, a lower wall and side walls for limiting the ability of the player to see items not altered by the mirror; and (f) disposing a flange member extending upwardly from the lower wall to limit visualizations to the image of the playing surface seen by the player to that seen in the mirror.

10. The method of claim 9, wherein step (c) comprises, more specifically, disposing the mirror in a support frame and attaching the support frame to the player with attachment means selected from the group consisting of a strap, ear hooks extending from the support device, and a hat.

11. The method of claim 9, further comprising:

(g) looking into the mirror and moving the movable member along the design.

* * * * *